US005897003A

United States Patent [19]

Muhlack

[11] Patent Number: 5,897,003

[45] Date of Patent: Apr. 27, 1999

[54] WALL ELEMENT

[76] Inventor: Horst Muhlack, Julienlusterweg 23, 24199 Kiel, Germany

[21] Appl. No.: 08/760,579

[22] Filed: Dec. 4, 1996

[30] Foreign Application Priority Data

Dec. 8, 1995 [DE] Germany ..... 295 19 431 U

[51] Int. Cl.[6] ..... A47B 73/00

[52] U.S. Cl. ..... 211/75; 211/87.01; 211/106

[58] Field of Search ..... 211/87.01, 74, 211/75, 106; 248/311.2

[56] References Cited

U.S. PATENT DOCUMENTS

| | | | |
|---|---|---|---|
| 954,805 | 4/1910 | Hitchcock | 211/75 |
| 2,005,939 | 6/1935 | Hibbard | 211/74 |
| 3,160,278 | 12/1964 | Varkala | 211/74 |
| 4,415,091 | 11/1983 | Wolff | 211/106 |

FOREIGN PATENT DOCUMENTS

| | | | |
|---|---|---|---|
| 6513910 | 5/1966 | Netherlands | 211/75 |
| 1102977 | 2/1968 | United Kingdom | 211/106 |

*Primary Examiner*—Peter R. Brown
*Assistant Examiner*—Anthony D. Barfield
*Attorney, Agent, or Firm*—Friedrich Kueffner

[57] ABSTRACT

A wall element serving for the presentation of goods includes a wall surface provided with inclined intersecting slots and at least one support or carrying unit releasably attached to the wall element, wherein the support unit protrudes beyond the wall surface and for support engages in at least two of the intersecting inclined slots, and wherein the support unit includes two downwardly converging support surfaces. The support unit is constructed in such a way that it offers room for several bottles which are placed on the support surfaces with the longitudinal axes of the bottles extending perpendicularly to the wall surface. In addition, the support unit includes a receiving device for another bottle which is aligned so as to extend with its longitudinal axis essentially parallel to the wall surface.

47 Claims, 6 Drawing Sheets

WALL ELEMENT

BACKGROUND OF THE INVENTION

1. Field of the Invention

The present invention relates to a wall element serving for the presentation of goods. The wall element includes a wall surface provided with inclined intersecting slots and at least one support or carrying unit releasably attached to the wall element, wherein the support unit protrudes beyond the wall surface and for support engages in at least two of the intersecting inclined slots, and wherein the support unit includes two downwardly converging support surfaces. The invention also relates to a support unit for such a wall element.

2. Description of the Related Art

DE-OS 43 27 843 of this applicant already discloses a wall element of the above-described type with releasably fastened support units which serve particularly for receiving and presenting printed products or blister packages, i.e., predominantly lightweight objects.

However, during experiments with the wall element to explore additional fields of use as well as during practical use, it has been found that the wall element is also very well suited for the presentation of heavy objects which protrude by a relatively large distance beyond the wall surface and, thus, the wall element can also basically be used for the presentation of bottles, for example, wine bottles or liquor bottles. However, while printed products and blister packages can be easily stacked one behind the other in the support units, so that a printed front side faces away from the wall element toward the front into the room and can be easily read, in the case of bottles the space required with respect to the necessary wall surface is very large if they were to be placed upright in the support units. In addition, upright bottles can be knocked over relatively easily especially during the removal of an adjacent bottle. Moreover, particularly in the case of the presentation of expensive wines, the wine bottles should not assume an upright position in the support units which would cause the corks to remain dry.

On the other hand, bottles which are stacked in the horizontal position have a much greater stability and require less space with respect to the necessary wall surface, however, the upwardly facing bottle labels cannot be read or can only be read very poorly without removing a bottle, so that this type of arrangement is not suitable for a sales presentation.

SUMMARY OF THE INVENTION

Therefore, it is the primary object of the present invention to improve the known wall element in such a way that it is also possible to present bottles in an optically pleasing manner, wherein the bottles are arranged on each support unit in a stable and safe manner and in such a way that they can be easily removed, without obstructing the view by an observer of the information on a bottle label.

In accordance with the present invention, the support unit is constructed in such a way that it offers room for several bottles which are placed on the support surfaces with the longitudinal axes of the bottles extending perpendicularly to the wall surface. In addition, the support unit includes a receiving device for another bottle which is aligned so as to extend with its longitudinal axis essentially parallel to the wall surface.

The invention is based on the concept of positioning always one of the bottles received by the support unit in an exposed position so that its label can be read easily, while the remainder of the bottles are stacked one on top of the other on the downwardly converging support surfaces, so that the bottles are prevented from dropping down or from being pushed down and the space requirement with respect to the necessary wall surface is reduced as much as possible.

In order to facilitate access to the stacked bottles, a preferred embodiment of the invention provides that the depth of the support surfaces is adapted to the bottle size in such a way that the bottle necks protrude beyond a front rim of the preferably plane support surfaces.

In accordance with an advantageous further development of the invention, the bottle extending with its longitudinal axis essentially parallel to the wall surface rests with its bottom against a bearing surface of the support unit, wherein the bearing surface is arranged preferably as an extension of one of the two support surfaces, wherein the longitudinal axis of the bottle preferably extends parallel to the other support surface.

The bottles placed in the receiving devices of all support units of a wall element are preferably aligned so as to extend parallel to each other, so that they are presented in an inclined position following the alignment of a portion of the slots, wherein this inclined position corresponds approximately to that position in which a wine stewart presents a wine bottle prior to opening, wherein, however, the label faces forwardly and not upwardly.

In accordance with another preferred further development of the invention, a bottle is prevented from falling out of the receiving device by constructing the receiving device such that it at least partially engages around the bottle in the area of the body of the bottle, so that the bottom of the bottle cannot move relative to the bearing surface to a significant extent and, thus, the bottle cannot slide from the bearing surface when the bottle bottom rests only partially against the bearing surface.

The wall elements without the support units are constructed in the manner as described in the aforementioned DE-OS 43 27 843 whose disclosure is incorporated herein by reference particularly in this respect. As described in DE-OS 43 27 843, the slots whose cross sections are L-shaped or preferably T-shaped each define a plurality of holding elements which are arranged inclined next to each other and which protrude beyond a support structure of the wall element, wherein the front end of the support structure widens so as to form a longitudinal recess or undercut adjacent to the slot.

The support units rest on the holding elements, wherein the support units each engage in at least two intersecting slots, so that they cannot tilt downwardly and rest in the area of the edges of the slots on several adjacent holding elements. The rear edge portions of the support units are preferably angled perpendicularly relative to the support surfaces and engage in the undercuts or longitudinal recesses behind the widened end faces of the holding elements, wherein the holding elements rest with their rear sides against the support structure and are supported thereby.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
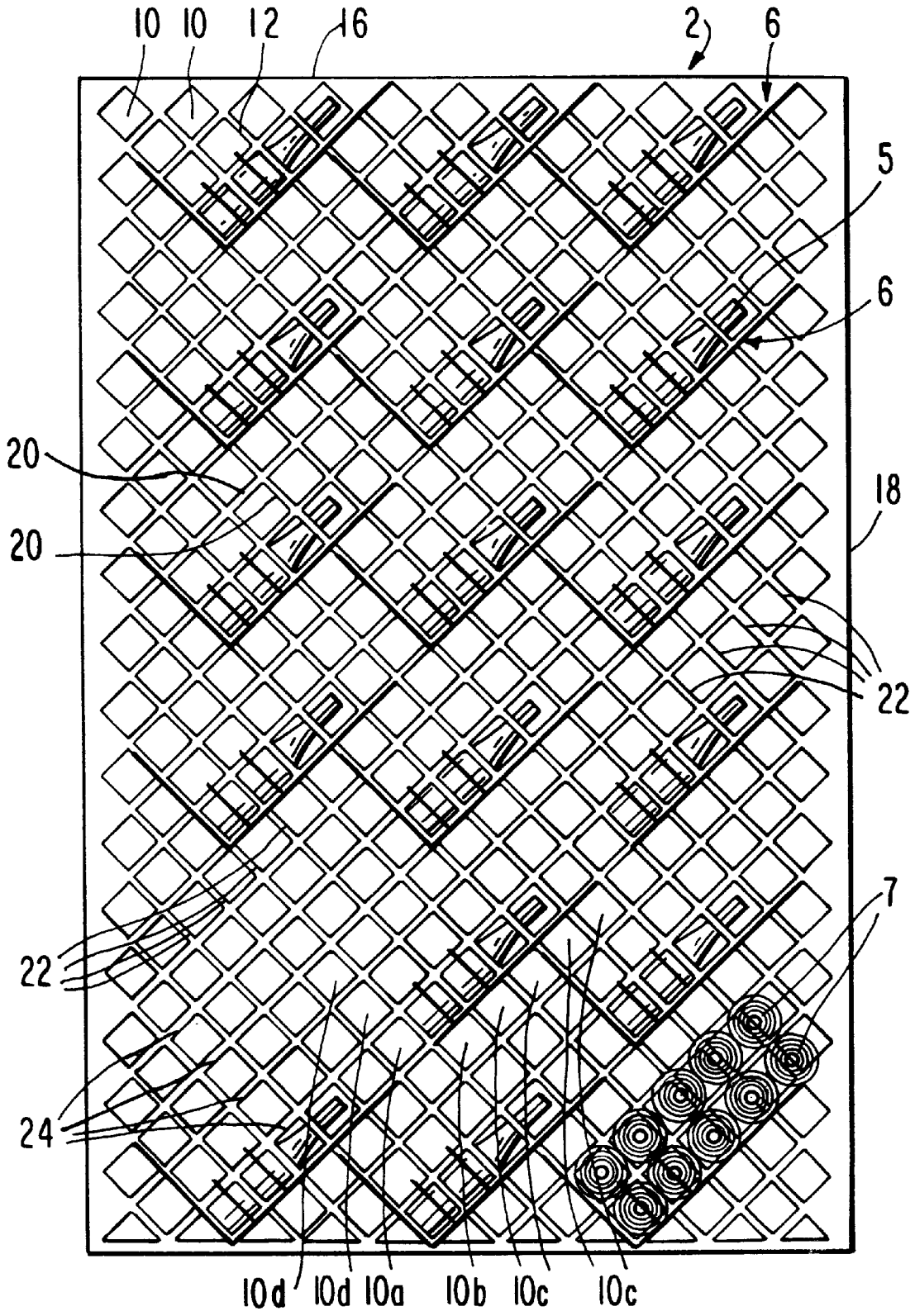
FIG. 1 is a front elevational view of a wall element according to the present invention with several bottle support units.

The wall element 2 illustrated in the drawing has the purpose of serving for the presentation of wine bottles, for example, in sales rooms of vineyards, wine cellars or wine stores. In the embodiment illustrated in FIG. 1, several support units 4, 6 are releasably attached to the wall element 2. Any other arrangement of support units next to each and/or on top of each other is also possible. The support units 4, 6 each support several wine bottles 5, 7 which, for example, may all be filled with the same wine from the same source and the same vintage. Always one bottle 5 of the wine bottles 5, 7 is presented to the observer in an exposed position with its label facing toward the front, while the remaining bottles 7 are arranged so as to lie horizontally on the support units 4, 6. The bottoms of the lying bottles face the wall element 2 and preferably rest against the wall element 2, while the necks face forwardly toward the observer, so that the bottles can be grasped easily and removed from the support units 4, 6.

Figure 4:
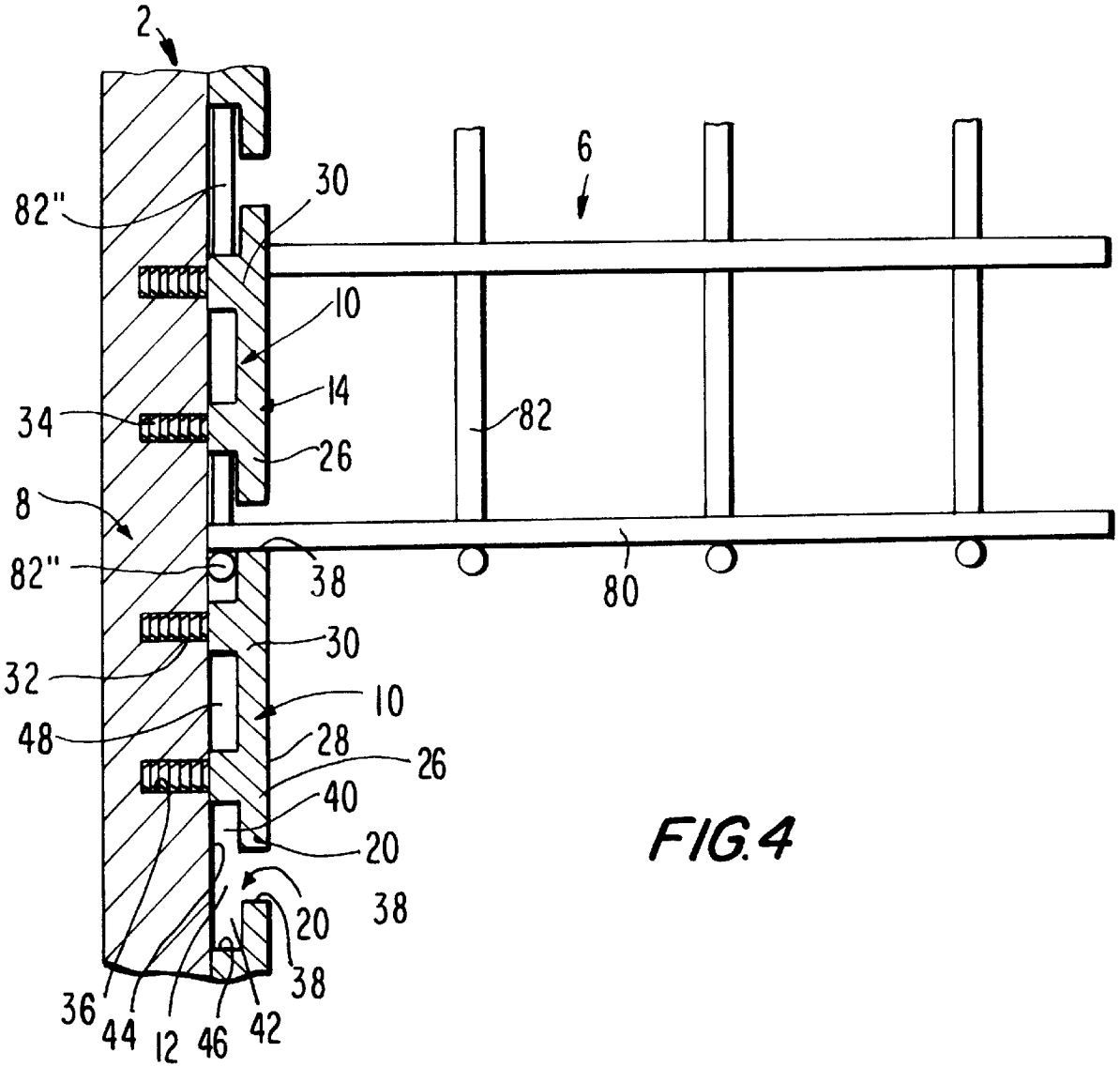
FIG. 4 is a longitudinal sectional view of a portion of the wall element of FIG. 1 with a portion of a bottle support unit according to FIG. 3.
Figure 5:
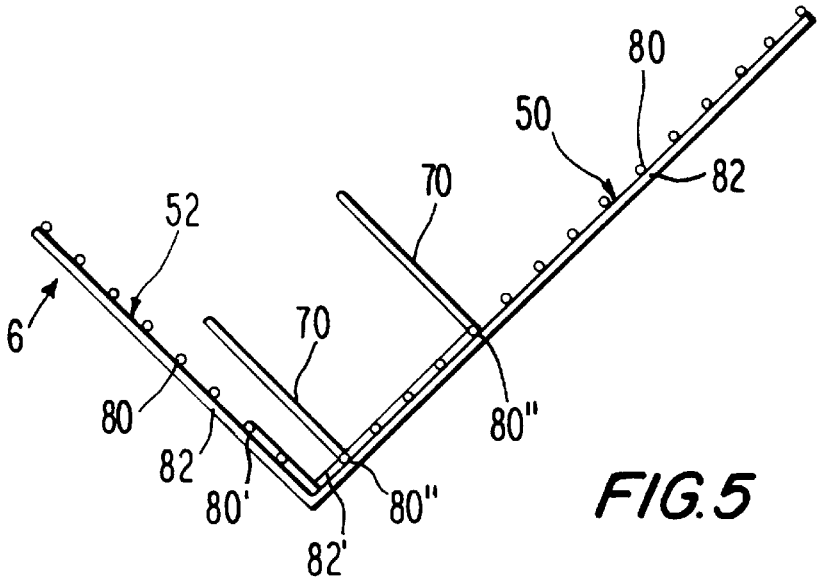
FIG. 5 is a front elevational view of the bottle support unit of FIG. 3.
Figure 6:
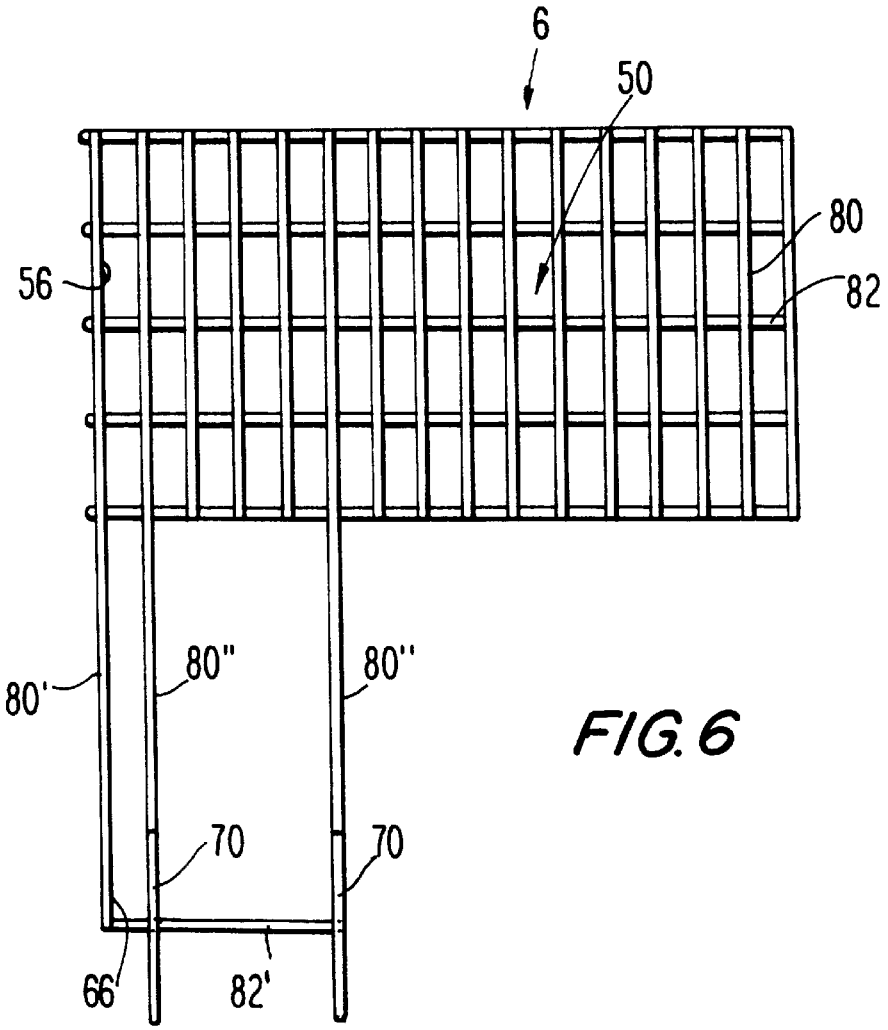
FIG. 6 is an oblique view from the top left of the bottle support unit of FIG. 5.
Figure 7:
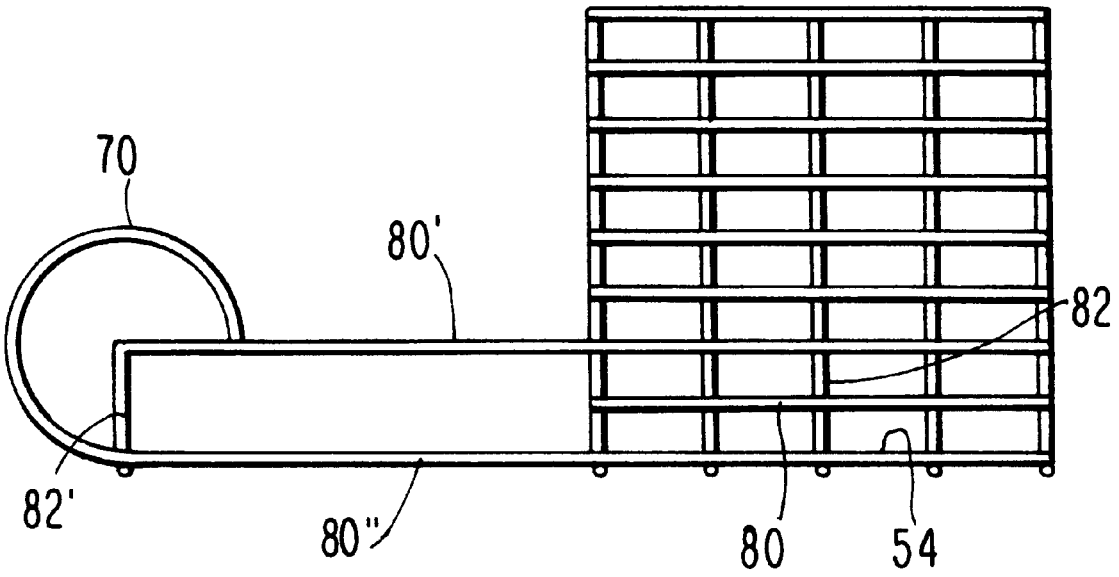
FIG. 7 is another oblique view from the right top of the bottle support unit of FIG. 5.

The wall element 2 is composed essentially of a rectangular continuous chip or particle plate 8 which forms the support structure of the wall element 2, and a plurality of holding elements 10 which are arranged at a distance from each other and protrude over a wide side surface of the particle plate 8, as shown in FIG. 4. The front ends 14 of the holding elements 10 facing away from the support structure have the form of congruent squares whose sides are in alignment with sides of adjacent squares and whose diagonals extend parallel to the horizontal and vertical side edges 16, 18 of the wall element 2. Intermediate spaces 12 are formed between the oppositely located sides of the adjacent holding elements 10, wherein the intermediate spaces 12 in alignment with each other in longitudinal direction form one of a plurality of parallel slots 20 which extend across the wall element 2 from the left top toward the right bottom and from the right top toward the left bottom, respectively.

The slots 20 form two groups 22, 24 of slots which intersect each other at an angle of 90°. However, the groups 22, 24 of slots can also include different angles with each other; in that case, the angles which are open toward the horizontal holder 16 and toward the vertical holder 18 have different sizes.

The holding elements 10 are constructed of synthetic material in an injection molding process and in one piece. The square front end 14 of the holding element 10 is formed by a plate-shaped part 26 which protrudes on all sides beyond a recessed square web 30 and which forms with its front side the wall surface 28.

The holding element 10 is provided with four dowels 34 which protrude toward the rear beyond the web 30 and which are arranged in the areas of the corners of the web 30 and are driven into corresponding bores 36 of the particle plate 8 for fastening the support element 10. The web 30 integrally formed with a plate-shaped part 26 rests with its plane rear surface 32 against the front side of the particle plate 8. Hollow spaces 48 between the particle plate 8 and the plate-shaped parts 26 of the holding elements 10 surrounded by the webs 30 serve to reduce the weight of the wall element 2.

Since the holding elements 10 have a forwardly widening shape, the intermediate spaces 12 between two adjacent holding elements 10 and, thus, also the slots 20 have a T-shaped cross section, wherein a leg of the T-shaped slot cross section is formed by the space between the parallel side rims 38 of two adjacent plate-shaped parts 26 and ends at the wall surface 28. The arms of the T-shaped slot cross section are formed by longitudinal recesses or undercuts 40 behind the edges 38 of the plate-shaped parts 26. The longitudinal recesses or undercuts 40 are each defined by a border 42 of the plate-shaped parts 26 which faces the particle plate 8 and protrudes outwardly beyond the web 30, by the surface area 44 of the particle plate 8 located opposite these surfaces 42, and by an outer surface 46 of the web 30.

The support units 4, 6 intended for receiving wine bottles are each constructed in one piece. The support units 4, 6 each include two essentially rectangular support surfaces 50, 52 of different lengths, wherein the support surfaces 50, 52 extend at the same angle as the slots 20 and converge toward each other in the shape of a V, wherein the inclined upwardly facing sides form plane support surfaces 54, 56 for wine bottles 7 placed on the support unit 4, 6. The width of the support surfaces 54, 56 is adapted to the size of the bottles 5, 7 in such a way that a front rim 58 of the two support members 50, 52 facing the room is located approximately below the transition between the body and the neck of the bottles 7, so that the necks of the bottles protrude forwardly beyond the support members 50, 52.

The bottles 7 are advantageously stacked on the support surfaces 54, 56 in such a way that the bottommost bottle rests on both support surfaces 54, 56 while the bottles placed thereabove either rest on one of the two support surfaces 54 or 56 and on another bottle, or on two adjacent bottles, in which case they rest in a recess formed between the bottles, as can be seen in FIG. 1.

The support units 4, 6 further include a receiving device 60 for the bottle 5 which is positioned in an exposed manner, wherein the bottle 5 protrudes forwardly beyond the support members 50, 52, and which holds the bottle in such a way that its longitudinal axis 62 is aligned so as to extend parallel to the slots 20 of one group 24 of the two groups 22, 24 of slots, wherein the bottle 5 essentially covers the lowest three to four bottles 7 of a row of bottles resting on the support surface 54 of the longer support member 50 toward the front either partially or entirely.

Figure 2:
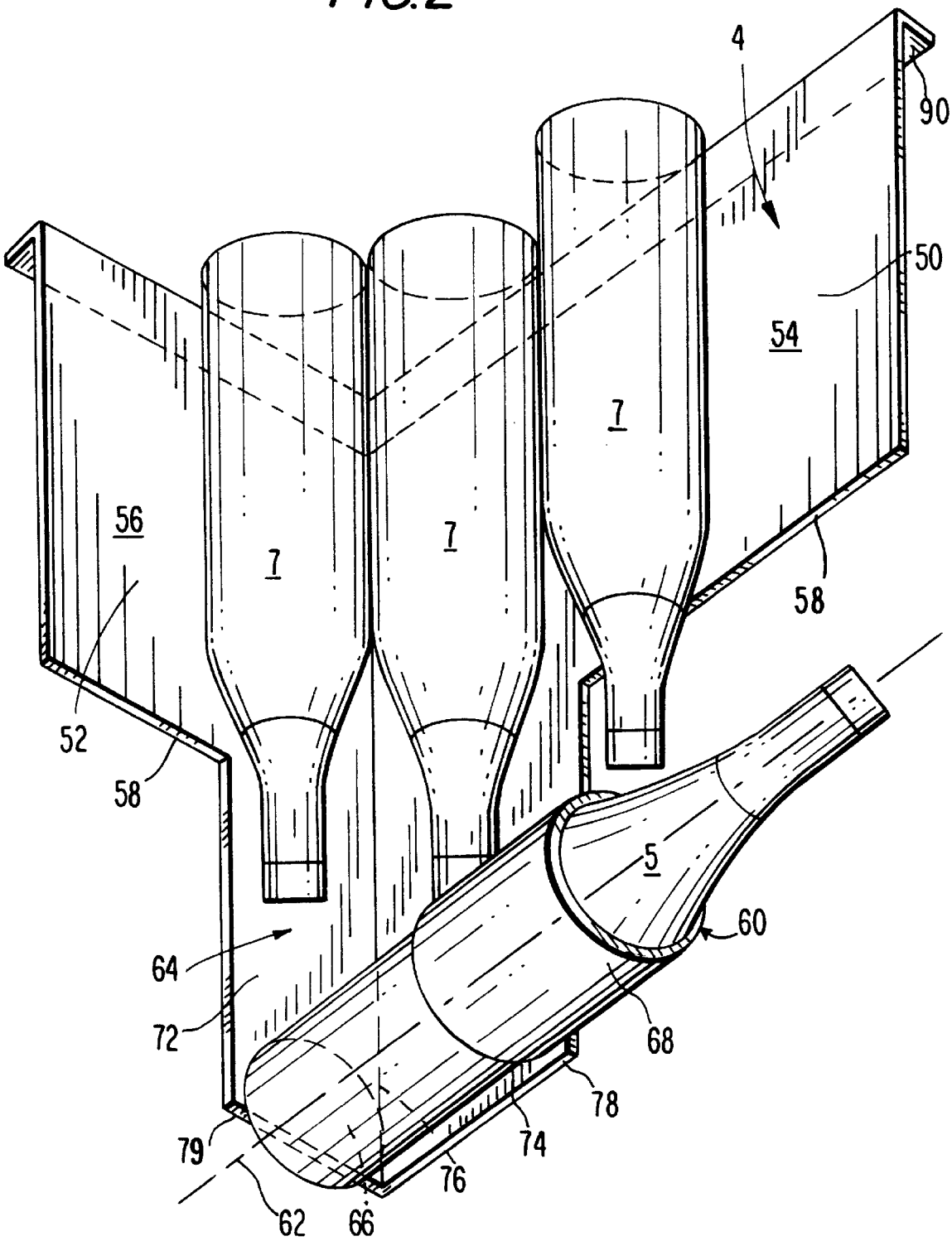
FIG. 2 is a perspective view, on a larger scale, of a bottle support unit removed from the wall element and holding four wine bottles.

The receiving device 60 is composed essentially of a cantilever 64 which forms a bearing surface 66 for the bottom of a bottle held by the receiving device 60 and which has at its front end a pipe piece 68, as shown in FIG. 2, or two stirrups 70, as shown in FIGS. 1 and 5–7, which engage entirely or partially around the body of the bottle and, thus, hold the bottom of the bottle on the bearing surface 66.

The cantilever 64 protrudes forwardly at the lower end of the two support members 50, 52 and forms an extension of the two support members 50, 52; more precisely, the cantilever 64 protrudes on both sides of the location where the two support members 50, 52 meet each other at an angle. The length of the cantilever 64 is adjusted to the length of the bottles 5, 7 in such a way that the front ends of those bottles 7 which are located totally or partially obscured behind a bottle 5 arranged in the receiving device 60 have a distance from the bottle 5 in the receiving device 60, so that the bottles can be removed without problems.

The construction of the cantilever 64 is advantageously adopted with respect to its configuration and material to that of the support units 4, 6. Thus, in the embodiment illustrated in FIG. 2, the cantilever 64 and the support device 4 proper are of transparent synthetic material, wherein the bearing surface 66 is formed by the upper side of a plate 72 which protrudes forwardly as an integrated part of the shorter support member 52, while the cylindrical tubular piece 68 of transparent synthetic material holds the bottle 5. The tubular piece 68 is on a portion of its outer circumference glued to a plate 74 which protrudes forwardly as an integrated part of the longer support member 50 and is connected in one piece along its bottom edge 76 to the bottom edge of the plate 72, wherein the forward rim 78 of the plate 74 is arranged in one plane with the forward rim 79 of the plate 72. The tubular piece 68 is fastened to the upper side of the plate 74 in the vicinity of the forward rim 78 of the plate 74, wherein the tubular piece 68 protrudes slightly forwardly beyond the plate 74, so that a bottle 5 inserted into the tubular piece 68 rests with its bottom only partially on the bearing surface 66.

The inner diameter of the tubular piece 60 is slightly greater than the outer diameter of the body of the bottle, so that the bottle can be easily pushed bottom first and from the top into the tubular piece 68. When the bottom of the bottle rests against the bearing surface 66, the tubular piece 68 surrounds the body of the bottle 5 underneath a transition between the body and the neck of the bottle. An upper rim and a lower rim of the tubular piece 68 extend parallel to the bearing surface 66 which, in turn, is aligned parallel to the slots 20 of one group 22 of the two groups 22, 24 of slots, while a longitudinal axis of the tubular piece 68 is aligned parallel to the slots 20 of the other group 24 of slots.

In contrast, in the embodiment illustrated in FIGS. 3–7, the entire support unit 6 and, thus, also the cantilever, are composed of stiff metal wire rods 80, 82 which are preferably manufactured of steel and may be chromium-plated or nickel-plated or provided with a sheathing of synthetic material. In the area of the support members 50, 52, the metal wire rods 80, 82 are welded together at a right angle and placed on top of each other to form a V-shaped metal wire grid having sides with different lengths, wherein the upper sides of the respectively upper rods 80 form the inclined support surfaces 54, 56. For forming the receiving device 60, some of the wire rods 80 extending perpendicularly to the wall surface 28 are extended forwardly; in the illustrated embodiment, altogether three wire rods 80 are extended, wherein one of the rods 80' protrudes beyond the shorter support member 52 and two rods 80" protrude beyond the longer support member 50. The extended wire rods 80', 80" are connected to each other for stiffening purposes by means of another wire rod 82'which is bent at a right angle and which forms the bearing surface 66 together with the front end of the extended wire rod 80'. The free ends of the extended wire rods 80" protruding beyond the wire rod 82' are each bent upwardly and rearwardly in a circular fashion so as to form the two stirrups 7 which are spaced apart from each other and engage around a major portion of the circumference of the body of the bottle held by the receiving device 60.

The two support units 4, 6 each rest against two holding elements 10*a*, 10*b* which are located diagonally opposite each other in horizontal direction at an intersection of two slots 20 and against additional adjacent holding elements 10*c*, 10*d* arranged above the holding elements 10*a*, 10*b*, as shown in FIG. 1, wherein, as shown in FIG. 4, the support units rest on the obliquely upwardly facing side edges 38 of the plate-shaped parts 26.

Figure 3:
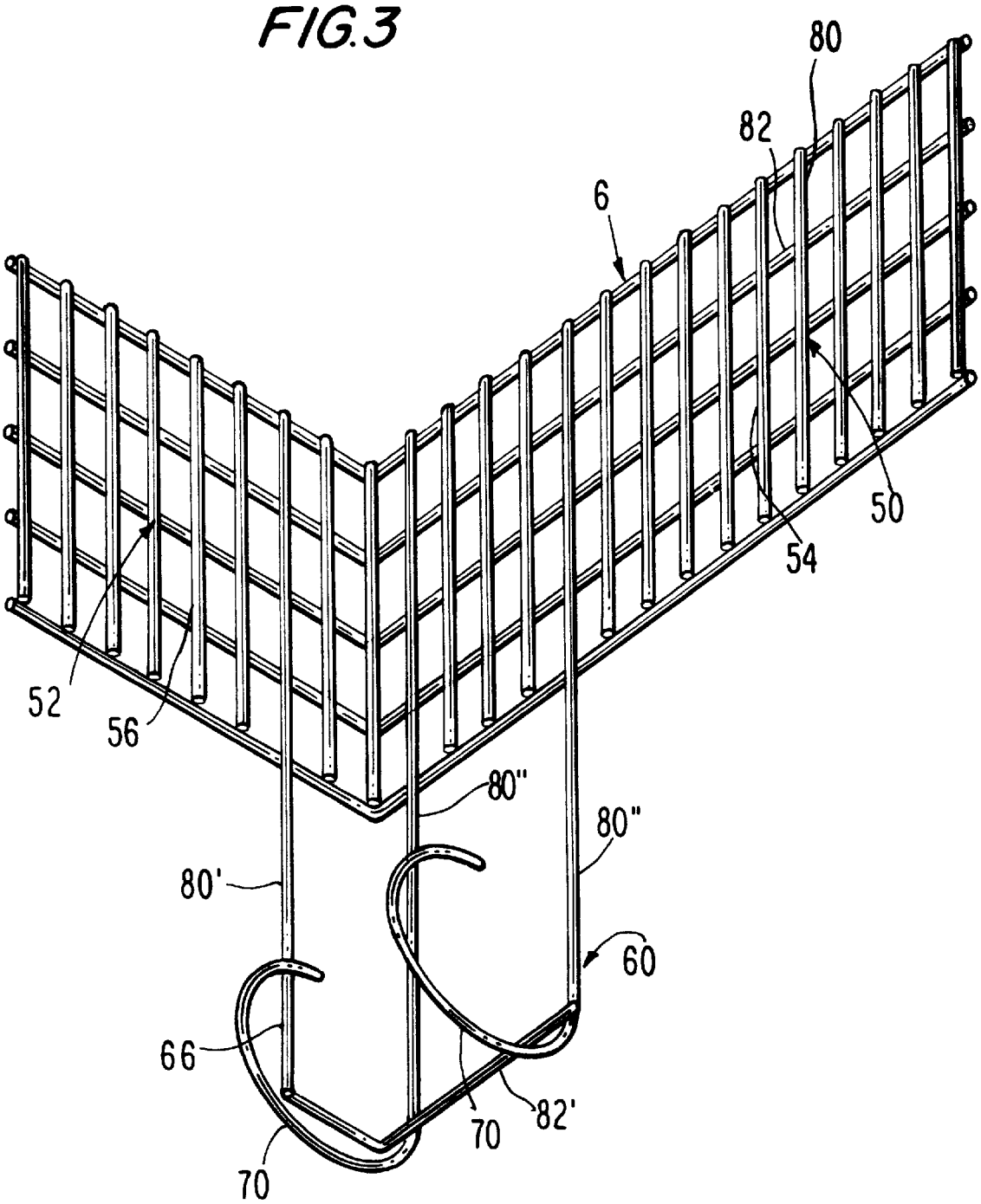
FIG. 3 is a perspective view of another bottle support unit without bottles and shown removed from the wall element.

The support units 4, 6 each engage with the rear border portion facing the wall element 2, i.e., with a rear border of the two support members 50, 52, in two intersecting slots 20, wherein, as shown in FIG. 3, a web 90 which may be divided and which protrudes downwardly beyond the rear border portion, or, as illustrated in FIGS. 3 and 4, the rearmost wire rod 82" of the wire rods 82 extending parallel to the wall surface, projects into the undercuts 40 behind the expanded front ends 14 of the holding elements 10 and rests against the particle plate 8, wherein, due to the V-shaped configuration of the support unit 4, 6, the support unit 4, 6 is prevented from tilting downwardly after being inserted into the slots 20.

To secure against an unintentional lifting, the support units 4, 6 can be clamped in the slots 20; for this purpose, a wedge, not shown, which is V-shaped in cross section is inserted, in the area of the V-shaped lower end of the support unit 4, 6 and so as to rest against the two upper sides of the support members 50, 52, between the support members 50, 52 and another holding element 10 arranged above the intersection of the slots 20 (the holding element 10 is obscured by the bottle in FIG. 1), so that the wedge engages in the intersecting slots 20. After clamping, the support units 4, 6 cannot be released from their seat even by forces which are directed from below against the support members 50, 52.

The invention is not limited by the embodiments described above which are presented as examples only but can be modified in various ways within the scope of protection defined by the appended patent claims.

I claim:

1. A wall element comprising a wall surface having two groups of parallel slots which intersect each other, a support unit releasably attached to the wall element, the support unit protruding beyond the wall surface and being in engagement with at least two of the slots, the support unit forming two support surfaces, the support unit being adapted for holding a plurality of bottles being placed on the support surfaces with longitudinal axes of the bottles extending perpendicularly to the wall surface, the support unit further comprising a receiving device adapted for receiving an additional bottle being aligned with a longitudinal axis thereof essentially parallel to the wall surface.

2. The wall element according to claim 1, wherein the support surfaces are adapted such that a bottommost of the bottles rests on both support surfaces, and bottles arranged above the bottommost bottle rest on one of two bottles and on one of the support surfaces and on another bottle.

3. The wall element according to claim 1, wherein the support surfaces each have a forward rim, the support surfaces being adapted such that a neck of a bottle placed in the support unit and resting with a bottom thereof against the wall surface protrudes beyond the forward rim of the support surfaces.

4. The wall element according to claim 1, wherein the support unit has a bearing surface adapted such that the additional bottle rests with a bottom thereof against the bearing surface of the support unit extending parallel to one of the two support surfaces.

5. The wall element according to claim 4, wherein the bearing surface is arranged so as to form an extension of one of the support surfaces.

6. The wall element according to claim 4, wherein the bearing surface is spaced from the wall surface by a distance which is greater than a length of the bottles.

7. The wall element according to claim 1, wherein the support surfaces are adapted such that the longitudinal axis of the additional bottle extends parallel to one of the two support surfaces.

8. The wall element according to claim 1, wherein the receiving device is adapted for surrounding at least partially a body of the additional bottle.

9. The wall element according to claim 1, wherein the support unit is made of metal wire rods.

10. The wall element according to claim 9, wherein the receiving device comprises at least one stirrup formed of a bent metal wire rod which is adapted to at least partially surround a body of the additional bottle.

11. The wall element according to claim 10, wherein the receiving device comprises two stirrups spaced apart from each other and adapted to surround the body of the additional bottle.

12. The wall element according to claim 4, wherein the bearing surface is formed by two metal wire rods arranged at an angle relative to each other.

13. The wall element according to claim 9, wherein the support surfaces are constructed as metal wire grids.

14. The wall element according to claim 9, wherein the support unit comprises at least two metal wire rods extended beyond a forward rim of the support surfaces.

15. The wall element according to claim 14, further comprising an additional metal wire rod for connecting the at least two metal wire rods.

16. The wall element according to claim 14, wherein forward ends of the metal wire rods are bent so as to form stirrups.

17. The wall element according to claim 1, wherein the support unit is a structural component of a synthetic material.

18. The wall element according to claim 17, wherein the support unit comprises two support plates arranged at an angle relative to each other, wherein upper sides of the support plates form the support surfaces.

19. The wall element according to claim 17, wherein the synthetic material is transparent.

20. The wall element according to claim 17, wherein the receiving device comprises a tubular piece of synthetic material for surrounding a body of the additional bottle.

21. The wall element according to claim 20, wherein the support unit comprises a cantilever protruding forwardly so as to form an extension of the support plates.

22. The wall element according to claim 21, wherein a portion of the cantilever forms a bearing surface for the additional bottle.

23. The wall element according to claim 21, wherein a portion of the cantilever is configured so as to support the tubular piece.

24. The wall element according to claim 1, wherein a first groups of parallel slots extends in a first diagonal direction of the wall element, and wherein a second group of parallel slots extends in a second diagonal direction of the wall element so as to intersect the first group of parallel slots.

25. The wall element according to claim 1, wherein the slots extend symmetrically relative to a vertical middle line of the wall element.

26. The wall element according to claim 1, wherein the slots extend symmetrically relative to a horizontal middle line of the wall element.

27. The wall element according to claim 1, wherein an angle between two intersecting slots open toward a horizontal border of the wall element is between 120° and 60°.

28. The wall element according to claim 27, wherein the angle is 90°.

29. The wall element according to claim 1, wherein the slots have on at least an obliquely upwardly directed side rim thereof a longitudinal recess.

30. The wall element according to claim 29, wherein each slot has an essentially T-shaped cross section forming a leg and arms, wherein the leg ends at the wall surface of the wall element, and wherein the arms form the longitudinal recesses.

31. The wall element according to claim 1, wherein side rims of the slots facing each other have a longitudinal recess.

32. The wall element according to claim 31, wherein each slot has an essentially T-shaped cross section forming a leg and arms, wherein the leg ends at the wall surface of the wall element, and wherein the arms form the longitudinal recesses.

33. The wall element according to claim 1, comprising a plurality of holding elements, the slots forming lateral borders of the holding elements, wherein the holding elements protrude toward an open side of the wall element beyond a support structure.

34. The wall element according to claim 33, wherein surfaces of the holding elements are defined by two slots of two groups of slots.

35. The wall element according to claim 34, wherein the surfaces of the holding elements have a diamond-shaped circumference.

36. The wall element according to claim 34, wherein the surfaces of the holding elements have a square-shaped circumference.

37. The wall element according to claim 33, wherein the holding elements are fastened individually to the support structure.

38. The wall element according to claim 33, wherein the slots are at the bottom thereof defined by a surface of the support structure.

39. The wall element according to claim 33, wherein the holding elements are attached to the support structure by means of dowels.

40. The wall element according to claim 33, comprising at least one dowel protruding beyond the holding elements and engaging in a bore of the support structure.

41. The wall element according to claim 33, wherein the support structure is a particle plate.

42. The wall element according to claim 33, wherein the holding elements are of synthetic material.

43. The wall element according to claim 33, wherein the support unit is supported by a plurality of holding elements.

44. The wall element according to claim 33, wherein the support unit is configured to be clamped in at least one slot between two adjacent holding elements.

45. The wall element according to claim 33, wherein the support unit rests on upwardly facing inclined side edges of several holding elements.

46. The wall element according to claim 33, wherein the support unit rests on at least two holding elements located diagonally opposite each other in horizontal direction at an intersection of two slots.

47. The wall element according to claim 33, wherein the support unit engages each holding element at a side thereof provided with at least one longitudinal recess.

* * * * *